US005230680A

United States Patent [19]

Wu

[11] Patent Number: 5,230,680

[45] Date of Patent: Jul. 27, 1993

[54] TORQUE VARIABLE EXERCISING APPARATUS

[76] Inventor: Hong-Chi Wu, No. 523, Ta-Hsiang St., Chung-Li City, Taoyuan Hsien, Taiwan

[21] Appl. No.: 852,779

[22] Filed: Mar. 17, 1992

[51] Int. Cl.[5] ..... A63B 21/06

[52] U.S. Cl. ..... 482/97; 482/99; 482/137; 482/138

[58] Field of Search ..... 482/94, 97-103, 482/133, 135-138, 908

[56] References Cited

U.S. PATENT DOCUMENTS

| | | | |
|---|---|---|---|
| 684,688 | 10/1901 | Herz | 482/97 |
| 3,306,611 | 2/1967 | Gaul | 482/103 |
| 3,573,865 | 4/1971 | Annas | 482/101 X |
| 3,731,922 | 5/1973 | Jungreis | 482/97 X |
| 4,407,495 | 10/1983 | Wilson | 482/97 |
| 4,627,614 | 12/1986 | De Angeli | 482/97 |
| 4,650,185 | 3/1987 | Cartwright | 482/97 |
| 4,753,437 | 6/1988 | Lapcevic | 482/97 |
| 4,834,367 | 5/1989 | Salter et al. | 482/100 |
| 4,890,830 | 1/1990 | Kern | 482/102 X |

FOREIGN PATENT DOCUMENTS

| | | | |
|---|---|---|---|
| 208551 | 4/1984 | German Democratic Rep. | 482/97 |
| 242563 | 2/1987 | German Democratic Rep. | 482/97 |
| 7609655 | 3/1978 | Netherlands | 482/103 |
| 1151656 | 5/1969 | United Kingdom | 482/102 |

*Primary Examiner*—Robert Bahr

*Attorney, Agent, or Firm*—Baker & Daniels

[57] ABSTRACT

A torque variable exercising apparatus includes a frame, a first cable-and-pulley arrangement and an impeding mechanism. The first cable-and-pulley includes a first cable having one end fixed to the frame and a second end incorporating an operating handle. The first cable moves up and down to pass a series of fixed pulleys and a first movable pulley. The impeding mechanism includes a second cable-and pulley arrangement mounted on the frame and connected to and suspending the first movable pulley, a vertical stand and a lever arm pivotally mounted on the vertical stand and having a first end connected to the second cable-and-pulley arrangement and a second end of the lever arm carrying a weight. The operating handle can be operated to apply a force at the first end of the lever via the second cable-and-pulley arrangement.

6 Claims, 4 Drawing Sheets

TORQUE VARIABLE EXERCISING APPARATUS

BACKGROUND OF THE INVENTION

1. Field of Invention

This invention relates to an exercising apparatus, more particularly to an exercising apparatus which includes an impeding means using a lever principle and a cable-and-pulley arrangement to provide a variety of torques to an exerciser.

2. Description of the Related Art

Exercising apparatuses are well known in the art. Exercising apparatuses which are to be used indoors should have a variety of resistances in order to suit every person. The conventional exercising apparatus generally includes a plurality of pull means associated with a plurality of weight means to counteract the pulls, thereby achieving the exercising operation. Discrepancy in weights can provide a variety of the resistances against the pulls. In order to exercise with this apparatus, the exerciser must pull the pull means, thereby providing a resistance for the exerciser.

The drawbacks of the conventional exercising apparatus are as follow:

(1) Since metal plates are employed in the apparatus, the collision between the metal plates during the up and the down motions of the operation causes disturbing noises.

(2) To vary the counterforce against the pull, some metal plates are removed or added to the load and are positioned thereat by a pin member. Locating a proper plate with the exact weight to be added or removed from the load is time comsuming.

(3) In the event that a cable interconnecting the pull means to the load is snapped, the metal plate will fly out thereby accidentally hurting a person who happens to be nearby.

SUMMARY OF THE INVENTION

Therefore, a primary object of the present invention is to provide an exercising apparatus which is free of the above-mentioned drawbacks.

Another object of the present invention is to provide an exercising apparatus which includes an impeding means including a lever arm and a cable-and-pulley arrangement which cooperatively provide a variety of torques to the exercising person.

In accordance with the present invention, the exercising apparatus includes a frame; a first cable-and-pulley arrangement which is mounted on the frame and which includes a first cable which has a first end fixed to the frame and a second end incorporating an operating handle, the first cable extending upward and downward and passing a series of fixed pulleys and a movable pulley, the operating handle being operable to move the first movable pulley in a first direction; and means for impeding the movement of the first movable pulley in the first direction. The impeding means includes a second cable-and-pulley arrangement mounted on the frame, and connected to a plurality of fixed pulley for hanging the first movable pulley and a second cable having a first end fixed to a top point of the frame, a vertical stand mounted on a base of the frame and an impeding lever arm pivotally mounted on the vertical stand and having a first end connected to the second cable-and-pulley arrangement to receive via the second cable-and-pulley arrangement a force applied to the first movable pulley, and a second end of the impeding lever arm carrying a weight to counteract the applied force.

BRIEF DESCRIPTION OF THE DRAWINGS

Other features and advantages of the present invention will become apparent in the following detailed description, including drawings, all of which show a non-limiting form of the present invention, and of which:

FIG. 3 (B) shows the variable torque mechanism of the exercising apparatus of the present invention, illustrating a configuration after being adjusted.

DETAILED DESCRIPTION OF THE PREFERRED EMBODIMENT

Figure 1:
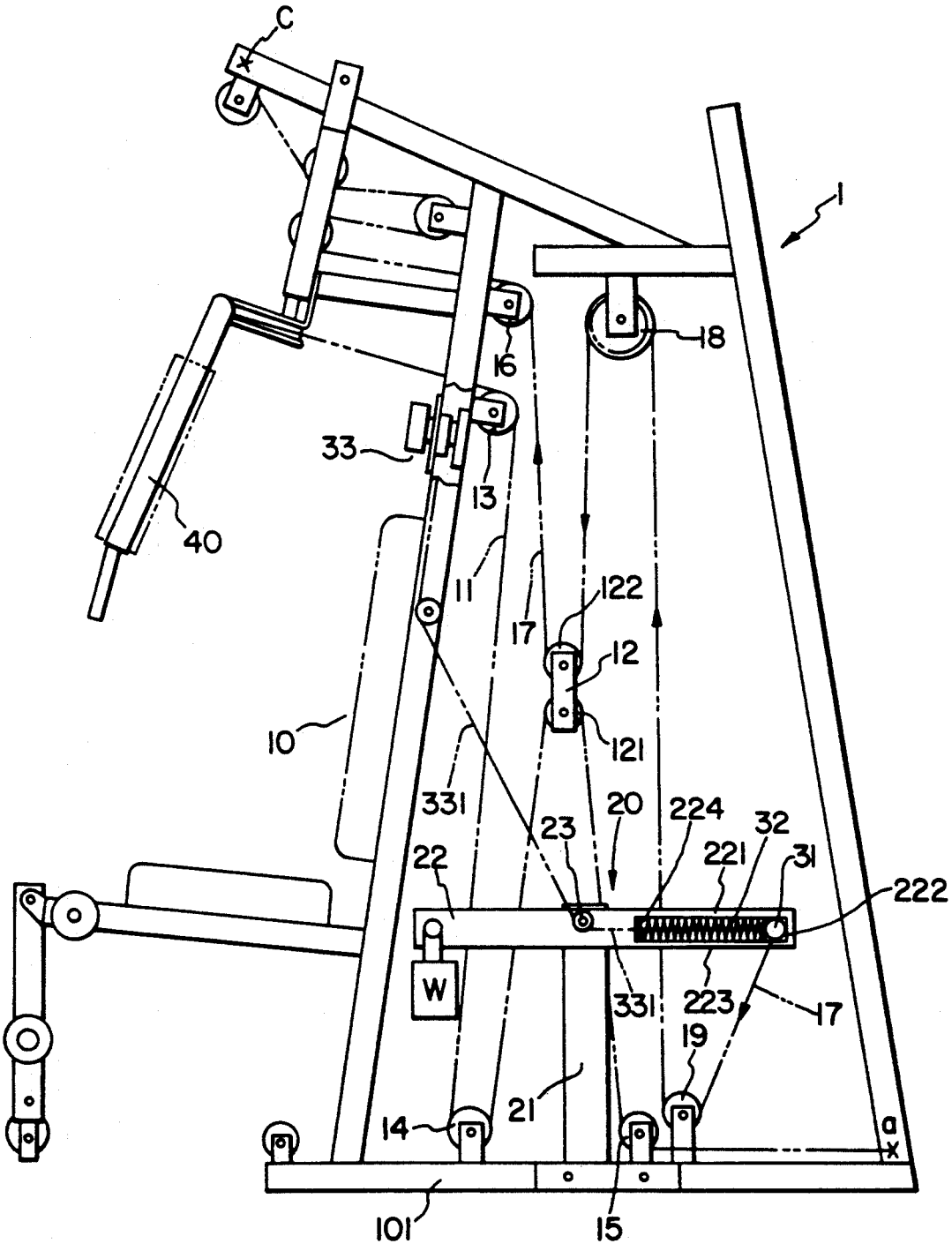
FIG. 1 shows an exercising apparatus of the present invention at an initial state.
Figure 2:
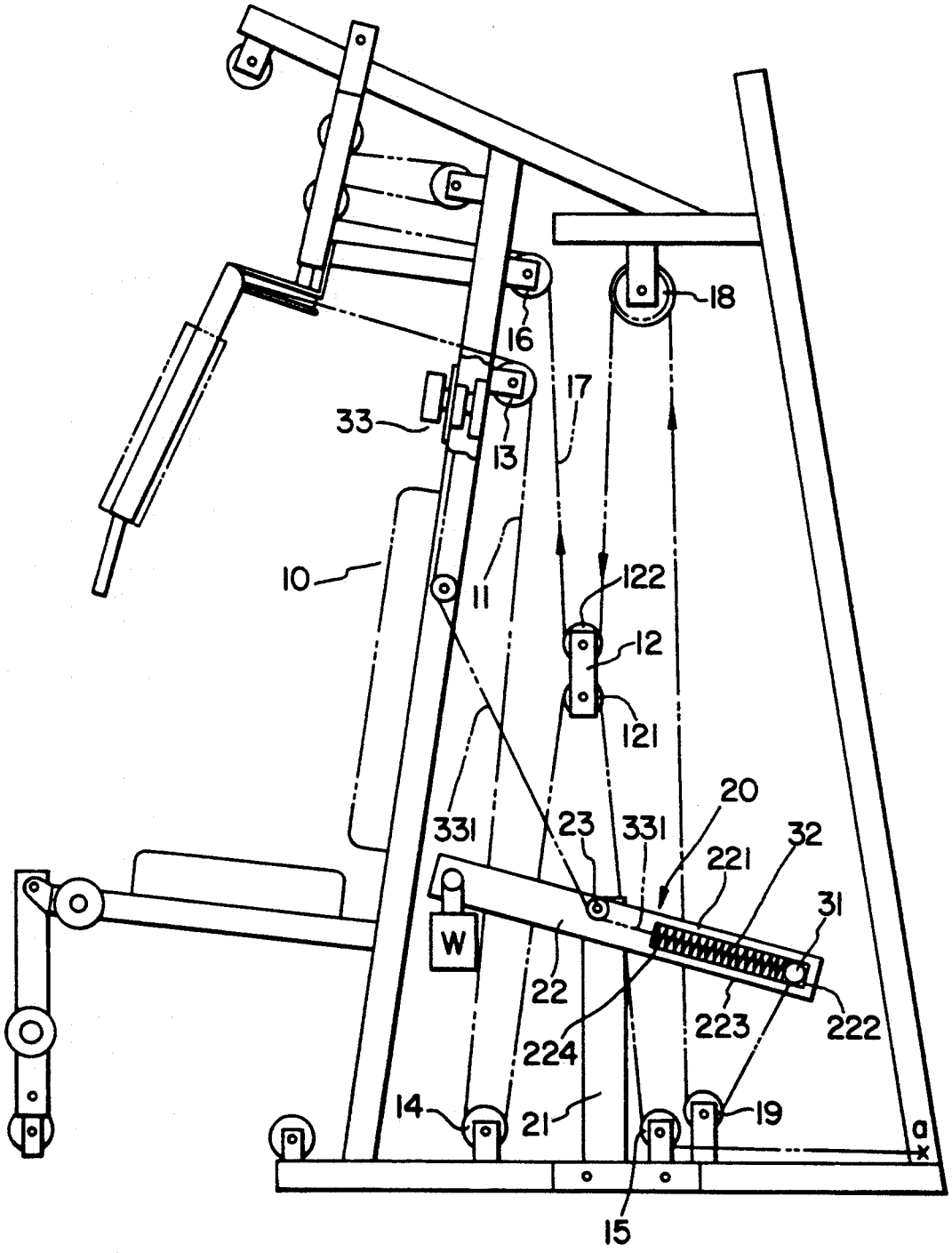
FIG. 2 shows the exercising apparatus of the present invention being operated.
Figure 3A:
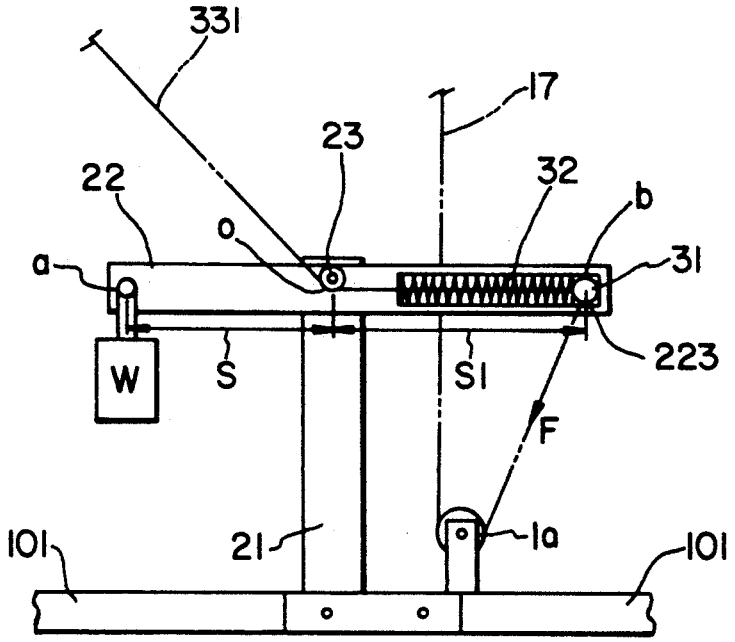
FIG. 3 (A) shows the variable torque mechanism of the exercising apparatus of the present invention, illustrating a configuration before adjustment.
Figure 3B:
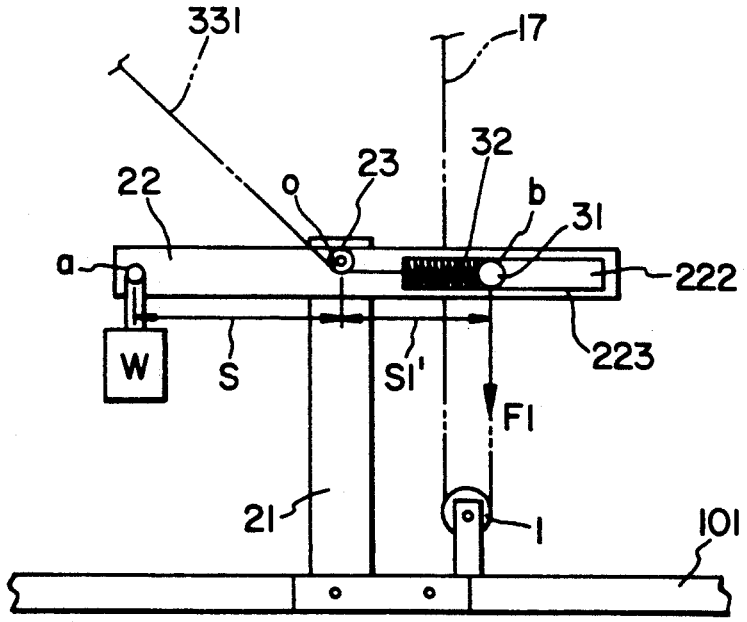

Referring to FIG. 1, the exercising apparatus according to the present invention includes a frame (1) having a base support (101) and a first cable-and-pulley arrangement mounted on the frame (1).

The first cable-and-pulley arrangement includes a first cable (11) which has a first end fixed to a point at "a" on the frame (1) and a second end connected to an operating handle (40). Exercising operation is achieved by operating the operating handle (40). Since methods for exercising the shoulders, the chest or legs are well known in the related art and are not directly concerned with the present invention, detailed description of such are omitted in the present specification. The first cable (11) extends up and down to pass a series of first fixed pulleys (13, 14, 15) and a first movable pulley (121) of a pulley block (12). A second cable-and-pulley arrangement includes a second cable (17) having one end fixed to a topmost point "C" of the frame (1). The second cable (17) also extends up and down similar to the first cable to pass a series of second fixed pulleys (16, 18, 19) and a second movable pulley (122) of the pulley block (12).

An important aspect of the present invention is that the apparatus includes a vertical stand (21) mounted on the base support (101) between the two fixed pulleys (14,15) and an impeding lever arm (22) having two opposite ends and an intermediate point (23) between the two opposite ends and being pivotally mounted at (23) on the vertical stand (21). A weight "W" is attached to an end of the lever arm (22). The lever arm (22) has a hollow recess (222) of a predetermined length extending from the other end thereof. A stud (31) and a compression spring (32) are provided in the hollow recess (222) wherein the compress spring (32) biases the stud (31) to abut against one end of the lever arm. The lever arm (22) also has an elongated slot (223) formed at a lower portion thereof so that a second end of the second cable (17) can pass through it to connect with the stud (31).

The apparatus further has an adjusting mechanism which includes a knob (33) mounted on the frame (1) and a third cable (331) having one end fixed to the knob (33) while a second end of the same connects the stud (31). In order to position the impeding lever arm (22) to be at an equilibrium, a force must be applied to the arm (22) to counteract the weight "W" at another end. This is achieved by arranging all the cables at a predetermined tension. Thus $W \times S = F \times S1$, where W is the weight, S is the distance of W relative to the pivot point (23), F is the applied tension force and S1 is the distance from the point of applied force relative to the pivot point (23).

Under this condition, when the operating handle (40) is pulled, i.e., a first force is applied whereby the first movable pulley (121) moves to a first direction, correspondingly moving the second movable pulley (122) downward. The downward movement of the second movable pulley (122) transmits a pull at the second end of second cable (17) which is connected to the stud (31). It is important to note that this first applied force can not compress the compression spring (32), and the counter force against the applied force comes from the weight "W". Thus a person can exercise with the present apparatus.

The applied force "F" can be varied by the rotation of the knob (33), wherein $W \times S = F1 \times S1'$, and since the "W" and "S" are constant and S1' is smaller than S1, F1 is accordingly greater than F. The exerciser must apply a force F1 greater than the force F after the adjustment of the compression tension of the compression spring (32) when exercising with this apparatus. An electronic knob can be provided instead of the knob (33) which can provide a micro-adjustment to the tension force.

Figure 4:
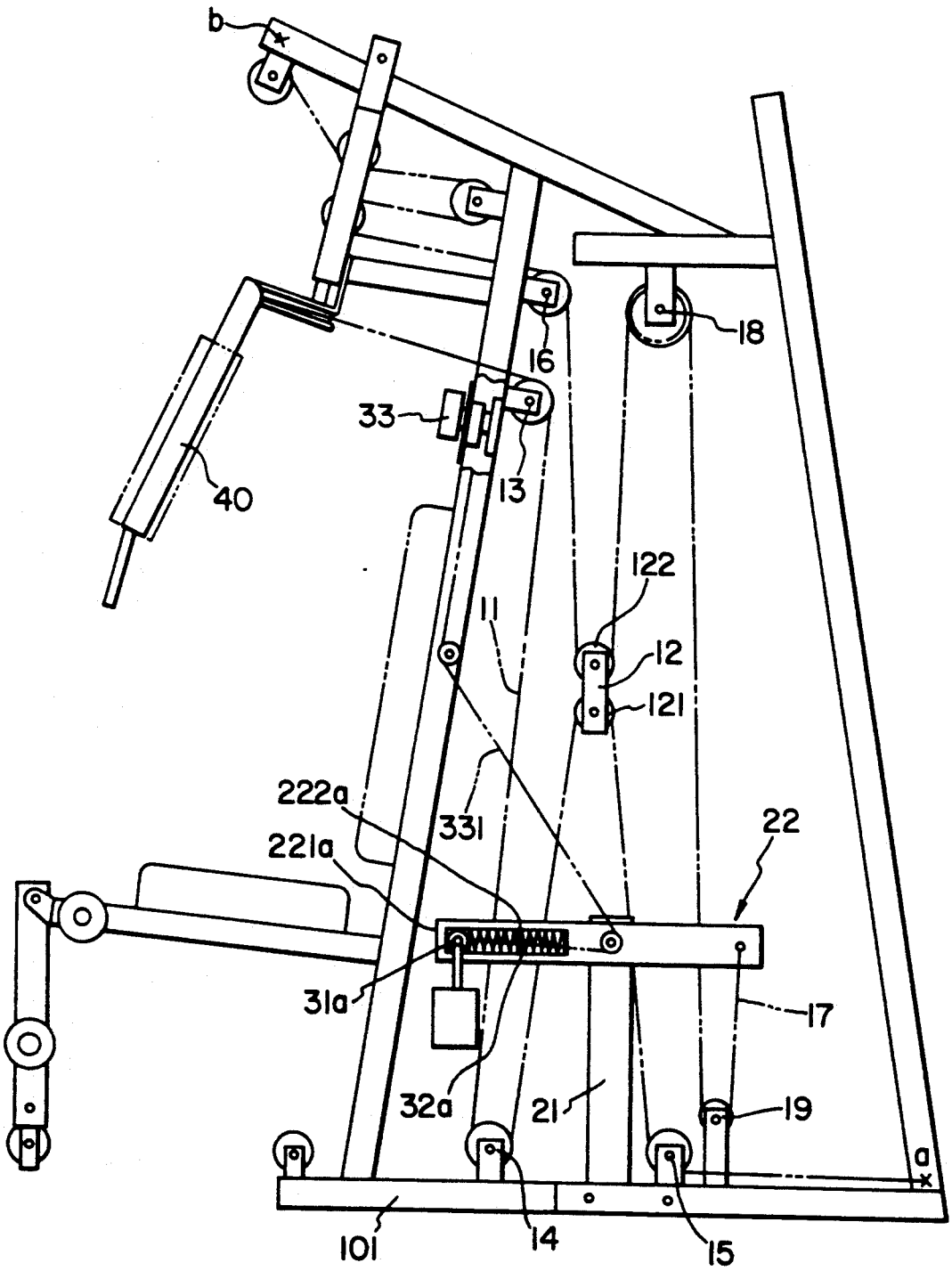
FIG. 4 shows another preferred embodiment of the exercising apparatus of the present invention.

FIG. 4 shows another preferred embodiment of the exercising apparatus of the present invention, in which the configuration of the lever arm has been altered. The features and functions are the same as in the preceding embodiment.

With the preferred embodiment as explained, it will be apparent that many changes and modifications may be made in the general constructions and arrangements of the present invention without departing from the spirit and scope of thereof. Therefore, it is desired that the present invention be limited not to the exact disclosure but only to the extent of the appended claims.

I claim:

1. A torque variable exercising apparatus, comprising:

a frame including a base portion;

an operating handle;

a plurality of first fixed pulleys mounted on said frame;

a first cable having a first end fixed to said frame and a second end connected to said operating handle, said first cable extending generally upward and downward to alternatingly engage said first fixed pulleys;

means for impeding operation of said operating handle including a vertical stand mounted on said base portion of said frame, an impeding lever arm mounted pivotally on said vertical stand and having a first end and a second end, said second end carrying a weight, and a second cable having a first end fixed to said frame and a second end connected to said first end of said impeding lever arm to counteract said weight; and a pair of first and second movable pulleys rotatably mounted within a pulley block;

said first cable passing over and pulling said first movable pulley in a first direction relative to said base portion of said frame, said second cable passing over and pulling said second pulley in a second direction opposite to said first direction to counteract pull of said first movable pulley, and said first and second cables cooperatively suspending said first and second movable pulleys on said frame.

2. A torque variable exercising apparatus according to claim 1 wherein said first direction is downward and said second direction is upward.

3. A torque variable exercising apparatus as claimed in claim 1, wherein said impeding lever arm has a stud mounted therein adjacent to said first end thereof, said second cable-and-pulley arrangement further including a series of second fixed pulleys hanging a second movable pulley which is connected to said first movable pulley, and said second cable having one end connected to said stud.

4. A torque variable exercising apparatus as claimed in claim 3, said lever arm further including a compressing spring provided therein biasing said stud to abut against said first end, thereby resiliently positioning said stud, wherein said stud is movable longitudinally of said lever against the compression force of said compression spring arm so as to vary the point at which said applied force is received by said lever.

5. A torque variable exercising apparatus as claimed in claim 4, wherein said apparatus further includes means for adjusting the force of said compression spring.

6. A torque variable exercising apparatus as claimed in claim 5, wherein said adjusting means includes a third cable having one end connected to a knob mounted on said frame and another end connected to said stud.

* * * * *